US006341777B1

(12) United States Patent
Carter

(10) Patent No.: US 6,341,777 B1
(45) Date of Patent: Jan. 29, 2002

(54) MULTIPLE-POSITION IDLER ROLLER

(75) Inventor: Daniel L. Carter, Georgetown, KY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/517,096

(22) Filed: Mar. 2, 2000

(51) Int. Cl.[7] ..... B65H 39/10; B65H 29/00; G03G 15/09

(52) U.S. Cl. ..... 271/291; 271/301; 271/304; 271/186; 399/373; 399/374

(58) Field of Search ..... 271/301, 291, 271/304, 186; 399/373, 374

(56) References Cited

U.S. PATENT DOCUMENTS 4,890,826 A * 1/1990 Rutishauser ..... 271/296 X
5,258,045 A * 11/1993 Yamashita ..... 271/225 X
5,317,377 A 5/1994 Rubscha et al. ..... 355/319
5,374,049 A 12/1994 Bares et al. ..... 271/186
5,382,013 A 1/1995 Walsh ..... 271/186
5,720,478 A 2/1998 Carter et al. ..... 271/902
6,186,501 B1 * 2/2001 St. Ours ..... 271/302 X

FOREIGN PATENT DOCUMENTS

JP 6-24620 * 2/1994 ..... B65H/29/60

* cited by examiner

*Primary Examiner*—Christopher P. Ellis
*Assistant Examiner*—Kenneth W Bower
(74) *Attorney, Agent, or Firm*—Linda M. Robb

(57) ABSTRACT

An inverter for reversing the orientation of a moving sheet includes a drive roller and an idler roller in circumferential contact in at least two positions, with a nip defined in each position.

8 Claims, 6 Drawing Sheets

MULTIPLE-POSITION IDLER ROLLER

BACKGROUND OF THE INVENTION

This invention relates generally to the art of paper sheet handling, and more particularly concerns a multiple position bidirectional idler roller for use in a sheet inverter system.

The invention is especially suited for use in the paper handling and inverter system of an electrophotographic printing machine and will be described with reference thereto; however, as will become apparent, the invention could be used in many types of paper sheet handling systems in a variety of different machines.

Although a sheet inverter is referred to in the copier/printer art as an "inverter", its function is not necessarily to immediately turn the sheet over (i.e., exchange one face for the other). Its function is to effectively reverse the sheet orientation in its direction of motion. That is, to reverse the lead and trail edge orientation of the sheet. Typically, in inverters as disclosed here, the sheet is driven or fed by feed rollers or other suitable sheet driving mechanisms into a sheet reversing chute. By then reversing the motion of the sheet within the chute and feeding it back out from the chute, the desired reversal of the leading and trailing edges of the sheet in the sheet path is accomplished. Depending on the location and orientation of the inverter in a particular sheet path, this may, or may not, also accomplish the inversion (turning over) of the sheet. In some applications, for example, where the "inverter" is located at the comer of a 90° to 180° inherent bend in the copy sheet path, the inverter may be used to actually prevent inverting of a sheet at that point, i.e., to maintain the same side of the sheet face-up before and after this bend in the sheet path. On the other hand, if the entering and departing path of the sheet, to and from the inverter, is in substantially the same plane, the sheet will be inverted by the inverter. Thus, inverters have numerous applications in the handling of either original documents or copy sheets to either maintain, or change, the sheet orientation.

In the field of reprographic machines, it is often necessary to feed a copy sheet leaving the processor of the machine along one of two alternate paths, particularly when the machine can selectively produce simplex (one-sided) and duplex (two-sided) sheets. Simplex sheets may be fed directly to an output tray, whereas duplex sheets may pass to a sheet feeder, which automatically reverses the direction of movement of a simplex sheet and feeds it back into the processor, but inverted, so that the appropriate data can be applied to the second side of the sheet.

Many inverters, particularly those utilizing only spring action or gravity, have reliability problems in the positive output or return of the sheet at a consistent time after the sheet is released from the inverter. Furthermore, inverter reliability problems are aggravated by variations in the condition or size of the sheet. For example, a pre-set curl in the sheet can interfere with feed-out and even cause the sheet to assume an undesirable configuration when it is released.

Paper curl is defined as any deviation from its flat state. In the xerographic process, fusing drives moisture out. When regaining moisture, paper experiences curl due to differential hygroexpansivity and thermoexpansivity between the paper and toner, and dimensional instability of paper due to its moisture history. The paper expands due to moisture reabsorption, but the toner does not expand, thus developing curl. Paper curl is one of the primary causes for paper handling problems in copying machines. In an inverter, problems such as stubbing result from copy sheet curl These problems are more severe for color copies than black and white due to differences in their toner mass area, substrates, and fuser characteristics.

The use of a curved chute within an inverter, i.e., curved sheet guides or baffles to define the reversing chamber for the sheet, will not necessarily insure the proper orientation of the trail edge of the sheet relative to the exit nip, or the leading edge of the sheet relative to the inverter nip. Also, different weights or thickness of paper will have different beam strengths, i.e. different self-straightening forces.

It is desirable to develop a new and improved sheet inverter apparatus which overcomes the above noted problems and others encountered in the prior art. The present invention meets these needs and others and provides a bi-directional inverter nip which is simple and not likely to damage the documents handled therein.

The following disclosures may relate to various aspects of the present invention:

U.S. Pat. No. 5,720,478 to Carter et al., teaches a gateless sheet inverter in which a curved portion of the sheet path branch intersects a second portion of the sheet path to form a curved inverter throat. As the sheet is driven from the curved branch portion of the path into the throat portion, the beam strength of the sheet causes the trail edge of the sheet to flip toward a second nip leading to the second sheet path. A pair of reversing rollers captures the lead edge of the sheet to be inverted and then reverses to drive the sheets out of the second nip formed by the tri-roller arrangement.

U.S. Pat. No. 5,382,013 to Walsh, discloses a paper inverter system having a clutch-driven inverter nip for maintaining a positive bidirectional contact with the sheet. A pair of opposing rollers defines a nip, with a shaft connected to one of the pair of opposing rollers. The clutch couples one end of the shaft to a drive system while the other end of the shaft is connected to a spring, which resists rotation of the shaft. The drive system rotates the shaft in a first rotational direction against the spring force. The clutch then decouples the shaft from the drive system for rotation in the opposing direction with the spring force.

U.S. Pat. No. 5,374,049 to Bares et al., discloses an inverter comprised of a reversible roller onto which a sheet is scrolled and subsequently unscrolled, thereby reversing the lead and trail edges of the sheet.

U.S. Pat. No. 5,317,377 to Rubscha et al., discloses a tri-roller inverter in which a passive deflector gate is deflected by a sheet driven by the input nip. The gate is deflected to an open position, which allows the sheet to enter the inversion chute. After the sheet is past the gate, the gate returns to a closed position, thus allowing the sheet to be driven past it in reverse by a reversing roller.

SUMMARY OF THE INVENTION

In accordance with one aspect of the present invention, there is provided an inverter for reversing the direction of a sheet moving along a paper path. The inverter includes a drive roller and an idler roller in circumferential contact in at least two positions. A nip is defined in each position.

In accordance with another aspect of the invention, there is provided a method of operating an inverter for reversing the orientation of a moving paper sheet. The method comprises receiving a lead edge of a moving sheet into a continuously driven first nip, which includes a continuously driven main drive roller and a first idler roller. A bi-directionally driven nip, which includes a forward/reverse driven roller and a multiple position idler roller, is then driven in a first direction to receive the lead edge of the sheet into the bidirectional nip. The forward/reverse driven roller then reverses to a second direction, thereby moving the trailing edge of the moving paper sheet into a second continuously driven nip having a continuously driven main drive roller and a second idler roller to expel the sheet from the inverter.

Pursuant to yet another aspect of the present invention, there is provided an electrophotographic printing machine having a device for inverting a sheet along a paper path. The inverting device includes a drive roller and an idler roller in circumferential contact in at least two positions. A nip is defined in each position.

BRIEF DESCRIPTION OF THE DRAWINGS

The foregoing and other features of the instant invention will be apparent and easily understood from a further reading of the specification, claims and by reference to the accompanying drawings in which:

All references cited in this specification, and their references, are incorporated by reference herein where appropriate for teaching additional or alternative details, features, and/or technical background.

While the present invention will be described hereinafter in connection with a preferred embodiment thereof, it should be understood that it is not intended to limit the invention to that embodiment. On the contrary, it is intended to cover all alternatives, modifications and equivalents as may be included within the spirit and scope of the invention as defined in the appended claims.

DETAILED DESCRIPTION OF THE INVENTION

Figure 1:
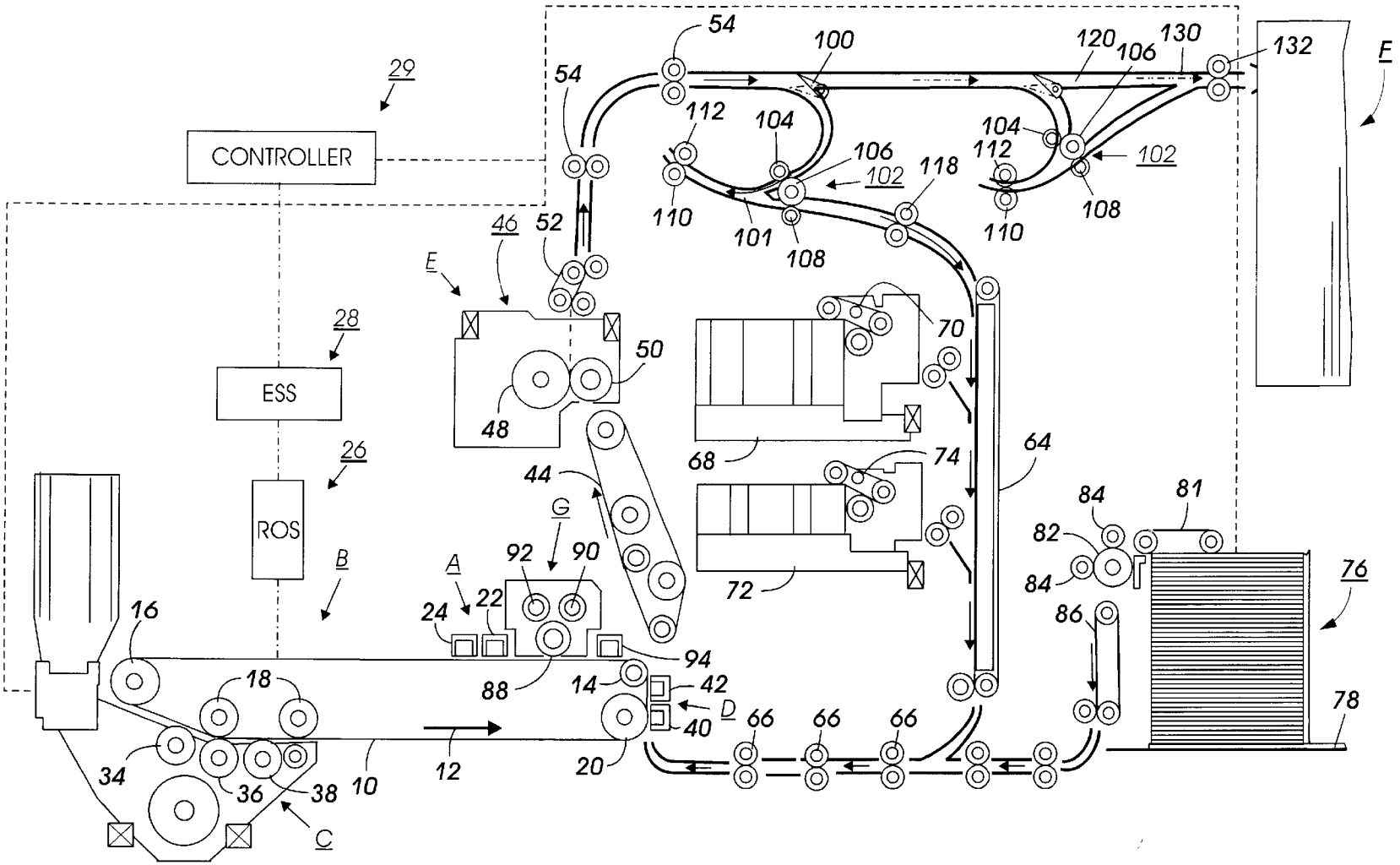
FIG. 1 is a side schematic elevational view depicting an illustrative electrophotographic printing machine incorporating a sheet inverting device of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the inverter device of the present invention may be employed in a wide variety of machines and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a selenium generator layer. The transport layer transports positive charges from the generator layer. The generator layer is coated on an interface layer. The interface layer is coated on the ground layer made from a titanium coated Mylar®. The interface layer aids in the transfer of electrons to the ground layer. The ground layer is very thin and allows light to pass therethrough. Other suitable photoconductive materials, ground layers, and anti-curl backing layers may also be employed. Belt 10 moves in the direction of arrow 12 to advance successive portions sequentially through the various processing stations disposed about the path of movement thereof. Belt 10 is entrained about stripping roller 14, tensioning roller 16, idler rollers 18 and drive roller 20. Stripping roller 14 and idler roller 18 are mounted rotatably so as to rotate with belt 10. Tensioning roller 16 is resiliently urged against belt 10 to maintain belt 10 under the desired tension. Drive roller 20 is rotated by a motor coupled thereto by suitable means, such as a belt drive. As roller 20 rotates, it advances belt 10 in the direction of arrow 12.

Initially, a portion of the photoconductive surface passes through charging station A. At charging station A, two corona generating devices indicated generally by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22. Next, the charged portion of the photoconductive surface is advanced through imaging station B.

At imaging station B, a raster output scanner (ROS), indicated generally by the reference numeral 26, discharges selectively those portions of the charge corresponding to the image portions of the document to be reproduced. In this way, an electrostatic latent image is recorded on the photoconductive surface. An electronic subsystem (ESS), indicated generally by the reference numerals 28, controls ROS 26. ESS 28 is adapted to receive signals from a computer and transpose these signals into suitable signals for controlling ROS 26 so as to record an electrostatic latent image corresponding to the document to be reproduced by the printing machine. ROS 26 may include a laser with a rotating polygon mirror block. The ROS 26 illuminates the charged portion of the photoconductive surface. In this way, a raster electrostatic latent image is recorded on the photoconductive surface, which corresponds to the desired information to be printed on the sheet. Other types of imaging systems may also be used employing, for example, a pivoting or shiftable LED write bar or projection LCD (liquid crystal display) or other electro-optic display as the "write" source.

Thereafter, belt 10 advances the electrostatic latent image recorded thereon to development station C. Development station C has three magnetic brush developer rollers indicated generally by the reference numerals 34, 36 and 38. A paddle wheel picks up developer material and delivers it to the developer rollers. When the developer material reaches rollers 34 and 36, it is magnetically split between the rollers with half of the developer material being delivered to each roller. Photoconductive belt 10 partially wraps about rollers 34 and 36 to form extended development zones. Developer roller 38 is a clean-up roller. A magnetic roller, positioned after developer roller 38 in the direction of arrow 12, is a carrier granule removal device adapted to remove any carrier granules adhering to belt 10. Thus, rollers 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roller is internally heated by a quartz lamp. Release agent, stored in a reservoir, is pumped to a metering roller. A trim blade trims off the excess release agent. The release agent transfers to a donor roller and then to the fuser roller.

After fusing, the copy sheets are fed through a decurler 52. Decurler 52 bends the copy sheet in one direction to put a known curl in the copy sheet and then bends it in the opposite direction to remove that curl. Forwarding rollers 54 then advance the sheet to duplex gate 100. Duplex solenoid gate 100 guides the sheet to the finishing station F, or to inverter 102. At finishing station F, copy sheets are stacked in a compiler tray and attached to one another to form sets. The sheets can be attached to one another by either a binder or a stapler. In either case, a plurality of sets of documents is formed in finishing station F.

When duplex solenoid gate 100 diverts the sheet into duplex path 101 the sheet is directed to the inverter 102 of the invention which will be described in detail below. The sheet is then directed back to transfer station D via conveyor 64 and rollers 66 for transfer of the toner powder image to the opposite side of the copy sheet. The duplex sheet may then be inverted again by being fed through the same path as the simplex sheet and directed by gate 120 into an output inverter 102 to be advanced to finishing station F.

Copy sheets are fed to transfer station D from the secondary tray 68. The secondary tray 68 includes an elevator driven by a bi-directional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rollers to advance successive copy sheets to transport 64 which advances the sheets to rollers 66 which feed the sheets to transfer station D.

Copy sheets may also be fed to transfer station D from the auxiliary tray 72. The auxiliary tray 72 includes an elevator driven by a directional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rollers to advance successive copy sheets to transport 64 which advances the sheets to rollers 66 to transfer station D.

Secondary tray 68 and auxiliary tray 72 are secondary sources of copy sheets. The high capacity sheet feeder, indicated generally by the reference numeral 76, is the primary source of copy sheets. Feed belt 81 feeds successive uppermost sheets from the stack to a take-away drive roller 82 and idler rollers 84. The drive roller and idler rollers guide the sheet onto transport 86. Transport 86 advances the sheet to rollers 66 which, in turn, move the to transfer station D.

Invariably, after the copy sheet is separated from the photoconductive belt 10, some residual particles remain adhering thereto. After transfer, photoconductive belt 10 passes beneath corona generating device 94, which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically-biased cleaner brush 88 and two de-toning rollers. The reclaim roller is electrically biased negatively relative to the cleaner roller so as to remove toner particles therefrom. The waste roller is electrically biased positively relative to the reclaim roller so as to remove paper debris and wrong sign toner particles. The toner particles on the reclaim roll are scraped off and deposited in a reclaim auger (not shown), where it is transported out of the rear of cleaning station G.

The controller 29 regulates the various machine functions. The controller 29 is preferably a programmable microprocessor, which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets. In addition, the controller regulates the various positions of the gates depending upon the mode of operation selected.

The invention herein has been illustrated in a high-speed black and white printing machine. It is also very suitable for use in a high-speed full color or highlight color printing machine.

Figure 2:
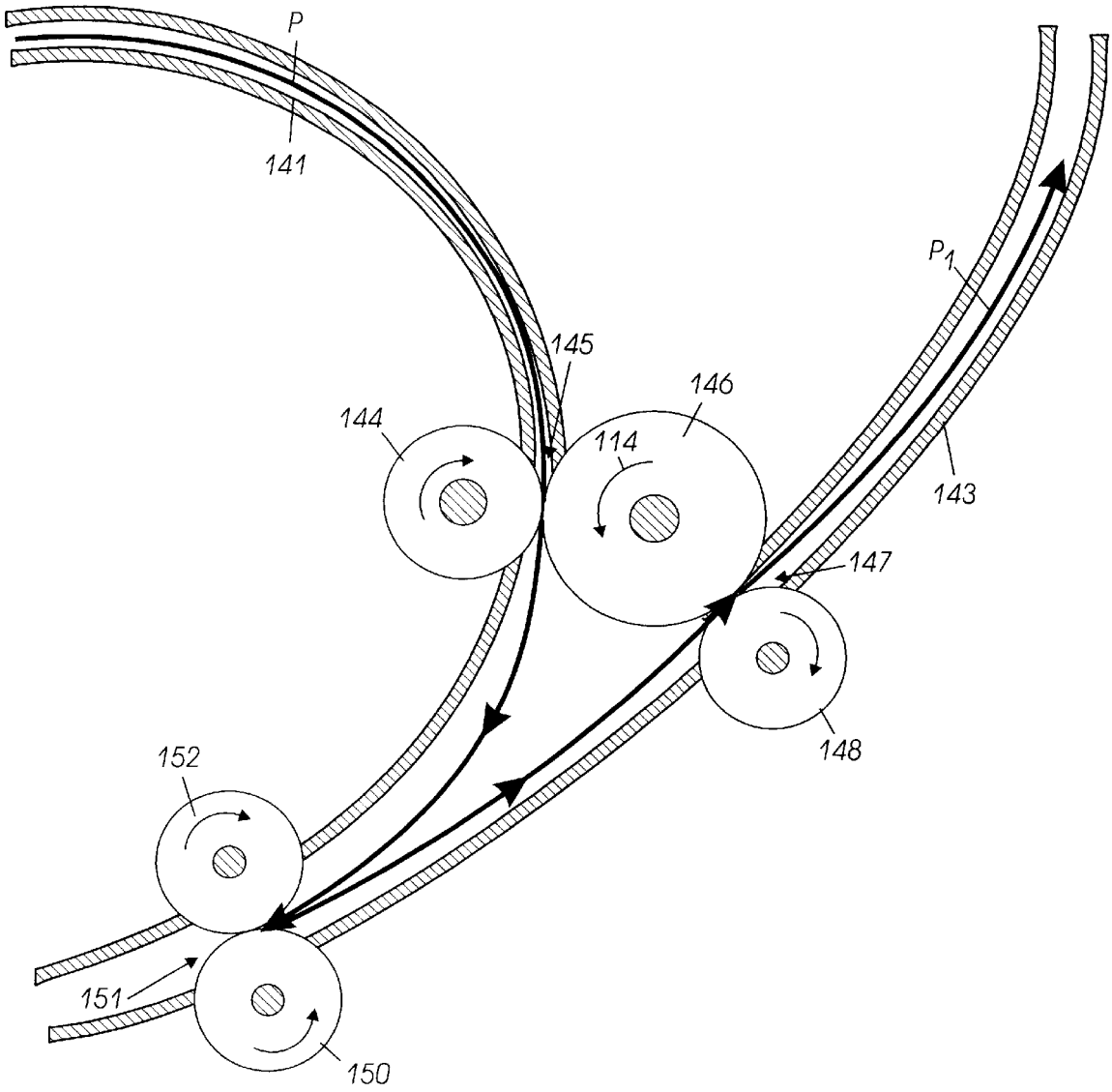
FIG. 2 is a detailed side elevational view of a prior art inverter.

By way of background a prior art inverter system is illustrated in FIG. 2 of the drawings. Broadly, as illustrated in FIG. 2, earlier inverter systems generally comprise guide means 141 and 143 which define a predetermined course of paper movement or path indicated generally by the lines P and $P_1$. In use, sheets are directed to a first pair of rollers 144 and 146. The rollers 144 and 146 are positioned in opposed relationship to define a first drive nip 145. Most commonly, only one of the rollers 144 or 146 is positively driven in the direction marked. Commonly, roller 146 is driven, whereas roller 144 is merely an idler roller.

Similar to the first input nip 145, a pair of rollers 146 and 148 are positioned in opposed relationship to define a second drive nip 147. Like the roller 144 the roller 148 is merely an idler roller.

An inverting station 102 includes a spaced pair of curved baffles between nips 151 and 147 and a pair of rollers 150 and 152 positioned in opposed relationship to define an inverter nip 151. Roller 150 is positively driven while roller 152 is an idler roller.

In use, a sheet is received into the first drive nip 145 and fed along the path P by the roller 146 whereupon the sheet leading edge contacts rollers 150 and 152 of inverter nip 151. As the trail end of the sheet passes through nip 145, the beam strength of the sheet causes the trail edge to flip to the lower baffle toward nip 147. The reversing nip 151 then drives the sheets out of the inverter toward nip 147 and the sheet is then driven by nip 147 along path $P_1$. At that point the sheet is then expelled from the inverter system through the second drive nip 147 by the rotational motion of the driven roller 146.

Because the geometry of the inverter throat is fixed, as is the position of the forward/reverse nip idler, there is little latitude for paper curl. This results in an inverter that has optimum position for paper curl latitude on output and paper stubbing (wear and damage to the edge of the original) on sheet input, when the leading edge of the sheet contacts one of the rollers in the inverter nip. This problem could be alleviated if the idler were not fixed, but instead could have multiple positions.

For a general understanding of the features of the instant invention having just discussed a popular prior inverter system, the preferred embodiment is best shown in FIGS. 3 through 6 of the drawings. In the drawings to follow, like reference numerals have been used throughout to designate identical or equivalent elements in the various embodiments. Also, the drawings are intended to illustrate the features of the present invention and are therefore not necessarily to scale. The system shown in the figures is specifically intended for use in an electrophotographic printing machine; however, the apparatus and system could clearly be used in a variety of other types of equipment incorporating sheet handling and transport systems.

Figure 3:
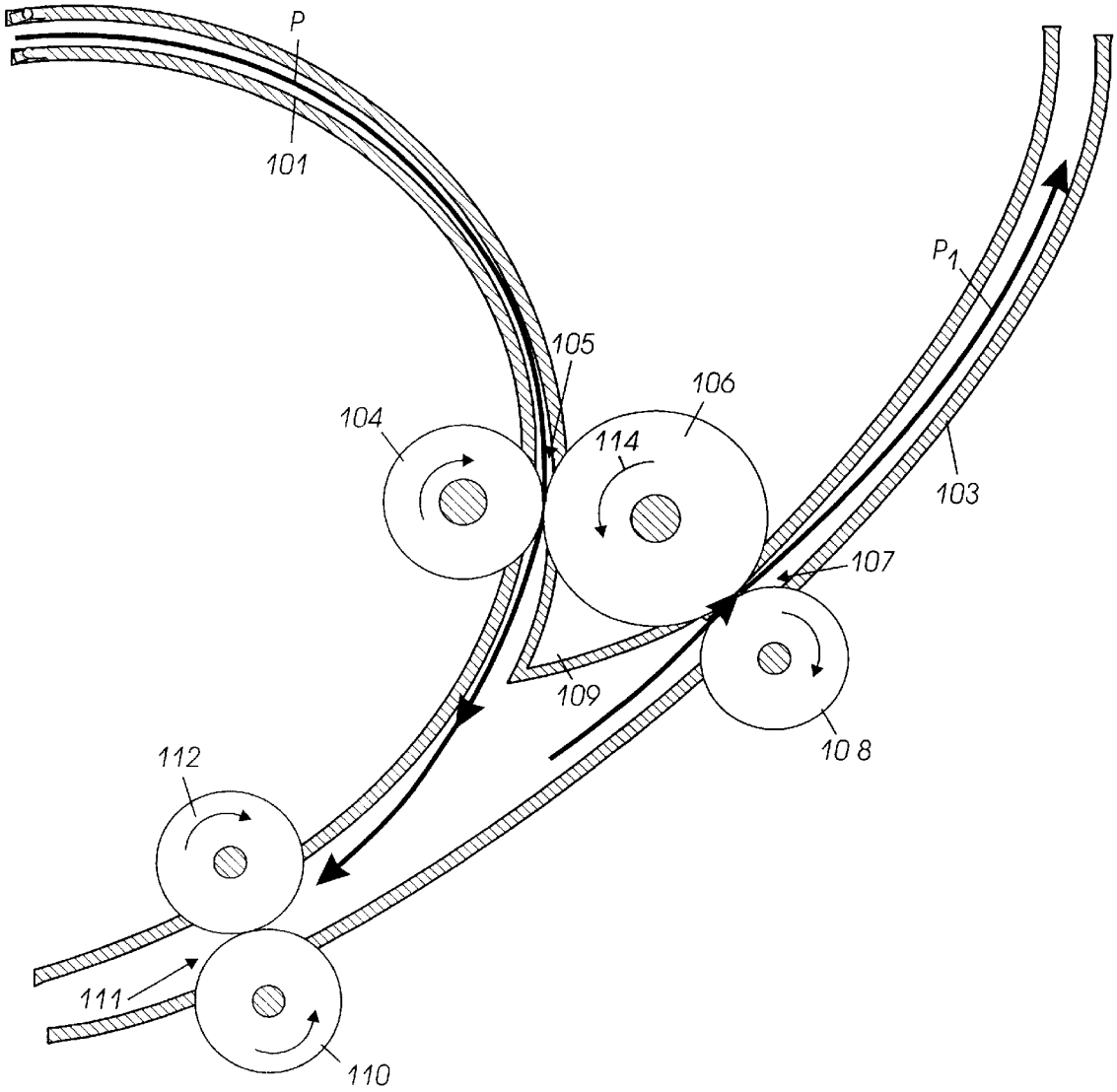
FIG. 3 is a detailed side elevational view of a first embodiment of a sheet inverter according to the invention herein.

FIG. 3 illustrates a detailed side elevation of the inverter system having a multiple position idler roller of the present invention. The inverter with a multiple-position idler includes a series of guide means 101 and 103 which define a predetermined course of paper movement or path indicated generally by the lines P and $P_1$. In the preferred embodiment, guide means 101 direct sheets to a first pair of rollers 104 and 106 which are positioned in opposed relationship to each other to define an input nip 105, which directs incoming sheets into the inverter. Roller 106 is driven in direction 114 while roller 104 is an idler roller.

An output nip 107 is defined by a pair of exit rollers 106 and 108 positioned in opposing relationship as illustrated in the figure. As with roller 104, the roller 108 is an idler and rotates with driven roller 106. Exit guide means 103 direct the inverted sheets to subsequent downstream electrophotographic operations along path P1 An assist to directing the trail edge of the sheet to exit nip 107 can be achieved by adding a fixed diverter 109 to direct the trail edge of the sheet into nip 107. The geometry of the diverter 109 is such that the throat leading to nip 107 is much wider than the throat from nip 105 thereby increasing the likelihood that the sheet will be directed to nip 107.

The inverter also includes a drive roller 110 and multiple position idler roller 112, which form inverter nip 111. Between nips 111 and 107 extends a curved baffle 103.

Figure 4:
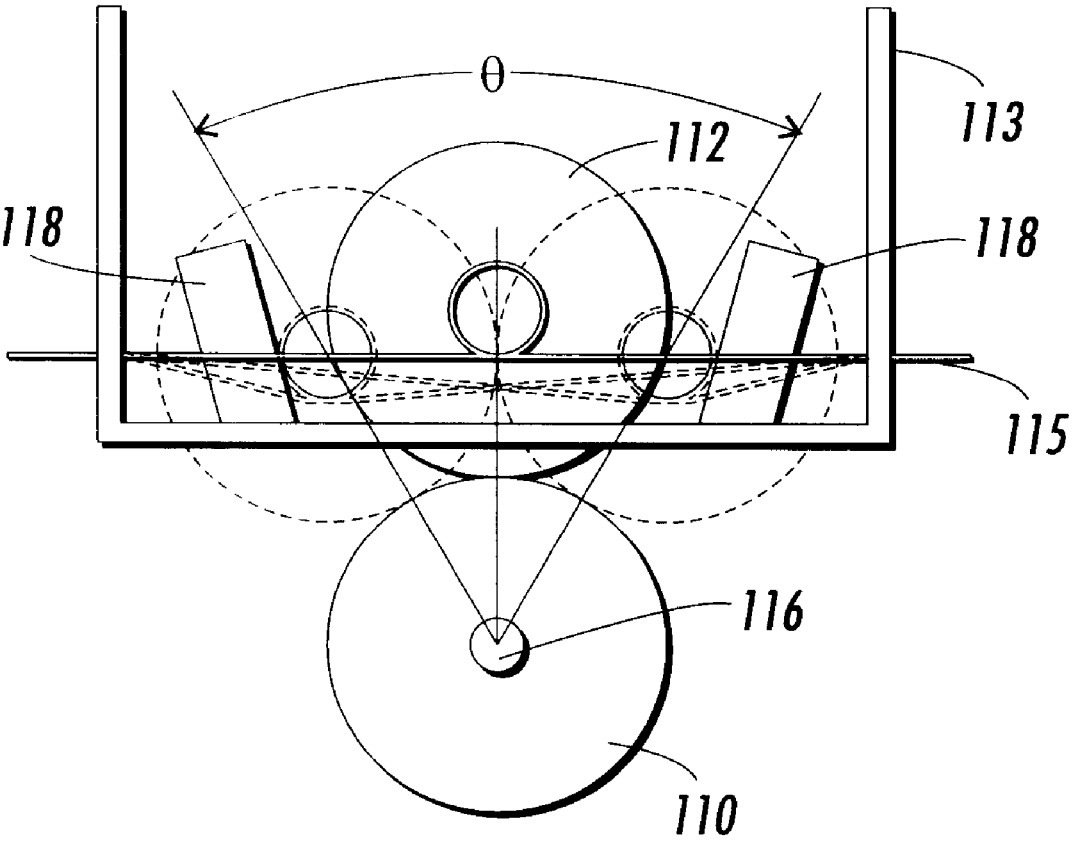
FIG. 4 is a detailed side elevational view of a portion of the inverter of FIG. 3, with added detail illustrating an embodiment of the invention herein.

Referring now to FIG. 4, torsion spring 115 supports and stabilizes idler roller shaft 116 and thereby holds idler roller 112 in pressing engagement with drive roller 110. Other suitable means for supporting the idler roller in pressing engagement with the drive roller may be employed, such as a garter spring or nip spring. Lateral movement of idler shaft 116 is constrained by guide stop 118 and idler bracket guide 113. The turning of the drive roller 110 causes the idler to be driven to each end of guide stop 118, depending on the direction of rotation of drive roller 110. As the drive roller rotates counterclockwise as a sheet enters the inverter, the passive idler roller 112 moves to a first position due to friction between the two rollers. As the drive roller rotates clockwise as a sheet leaves the inverter, the passive idler roller moves to a second position, through an angle θ. In the preferred embodiment this movement of the multiple position idler from a first position to a second position through angle θ is within the range of about 5° to about 15°. This movement permits improved sheet curl latitude in the inverter, as illustrated in FIGS. 5 and 6.

Figure 5:
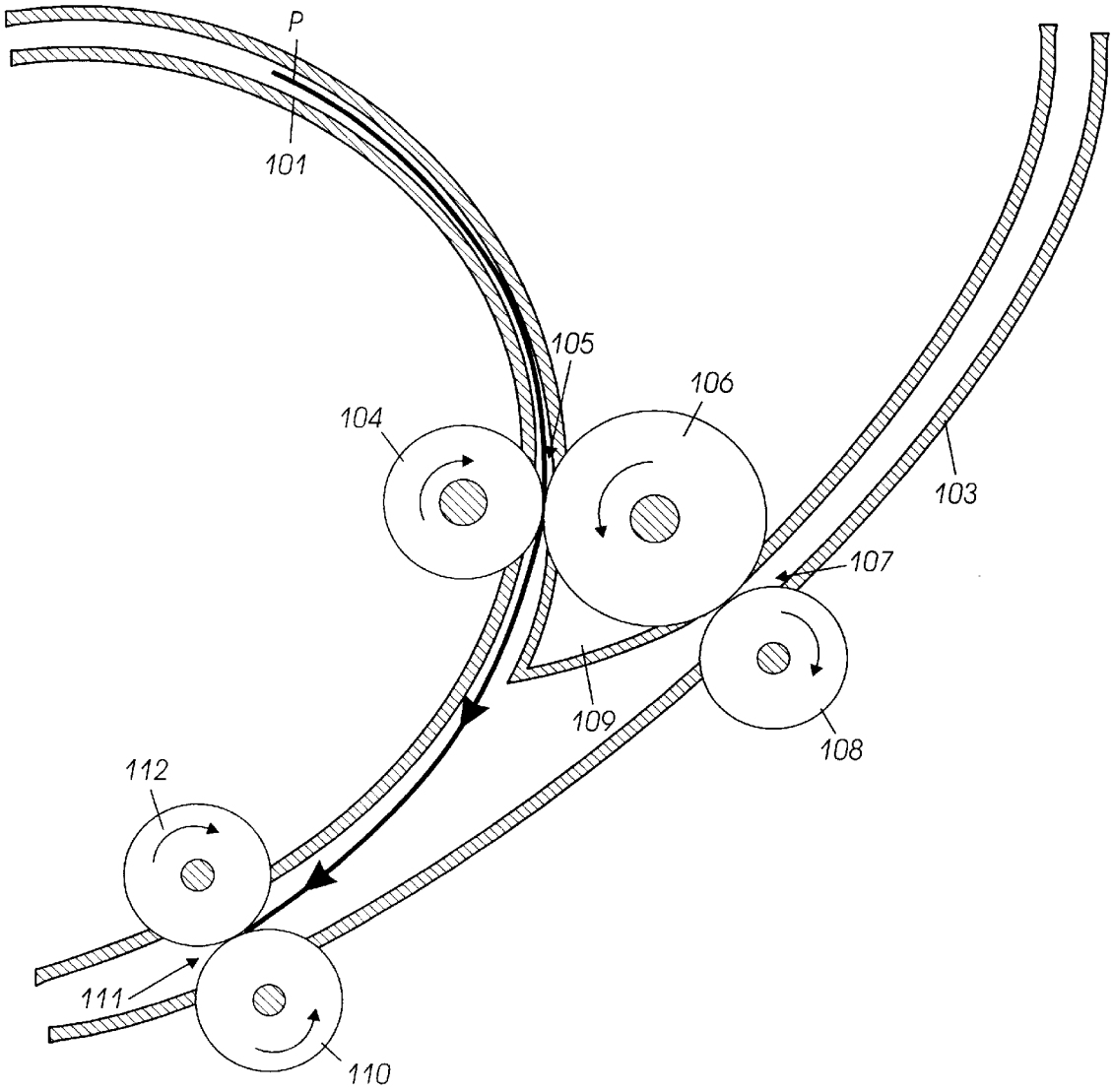
FIGS. 5 and 6 are detailed side elevational views illustrating the operation of the invention herein.

FIG. 5 illustrates the inverter of the present invention with the multiple position idler 112 in a first position, which would occur when the drive roller 110 is rotated counterclockwise and a sheet is entering the inverter. In this position idler 112 has rotated through angle θ, placing the idler and drive roller in a configuration such that a line drawn through their axes is perpendicular to the sheet path P, for less chance of stubbing.

Figure 6:
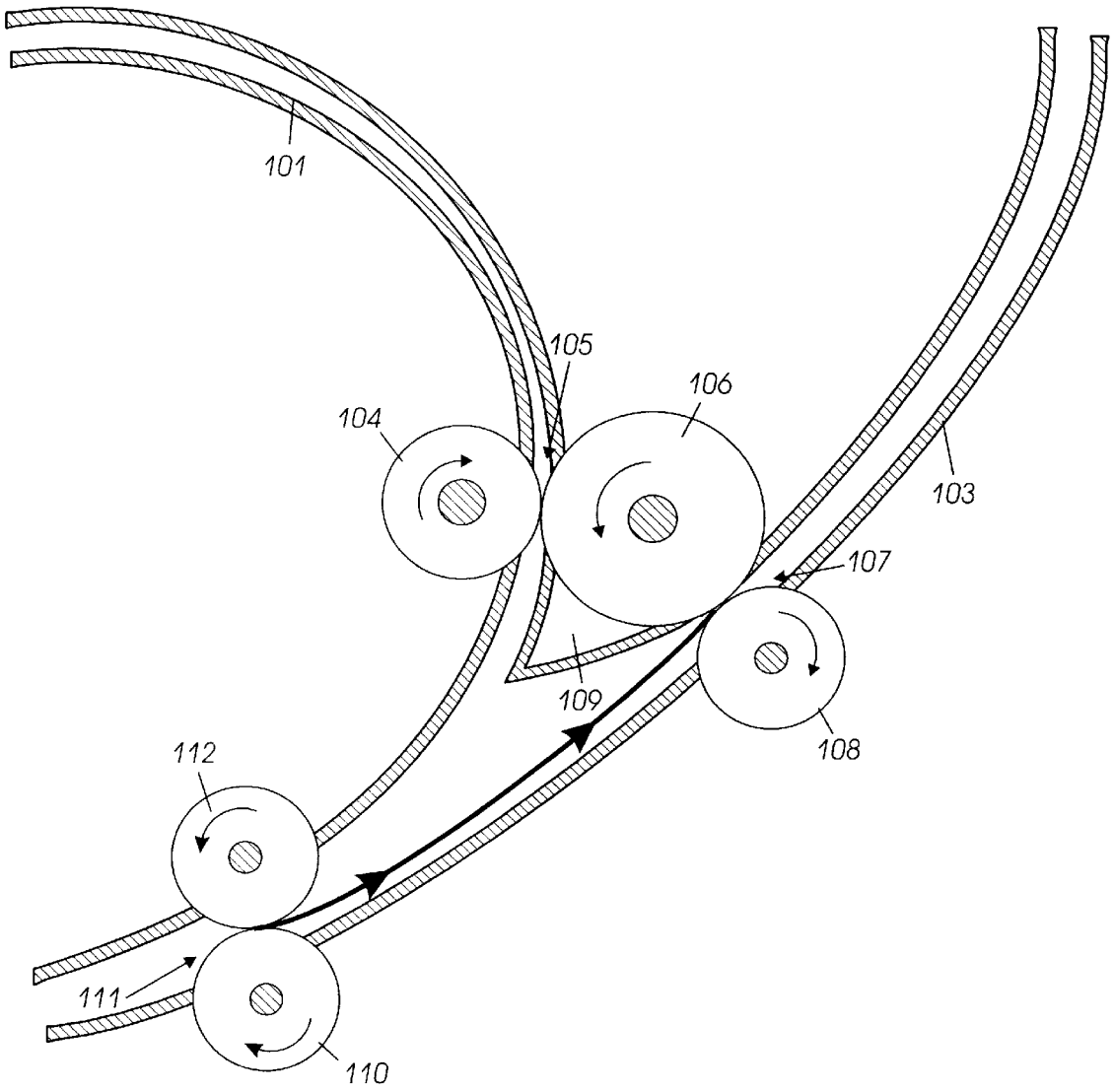

FIG. 6 illustrates the inverter of the present invention with the idler 112 in a second position, which occurs when the drive roller 110 is rotated clockwise and a sheet is leaving the inverter. In this position, idler 112 has moved in the reverse direction back through angle θ, thereby increasing the curl radius that can be accommodated by the inverter. For example, if the idler 112 is moved clockwise by 10 degrees from a first position at 19° from vertical to a second position at 9° from vertical, the curl radius that can be accommodated goes from 170 mm to 120 mm, a significant improvement in curl latitude, for paper having a thickness of 0.4064 mm.

In recapitulation, there is provided a device for inverting a sheet along a path in an electric photographic printing machine. A sheet inverter is provided including a bidirectional nip having a forward/reverse drive roller and a multiple position idler roller in opposition to each other. The multiple position idler roller moves about the forward/reverse drive roller to accommodate an improved range of paper curl.

It is, therefore, apparent that there has been provided in accordance with the present invention, a bidirectional nip apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An inverter for reversing the orientation of a moving sheet, comprising:

a drive roller; and an idler roller in circumferential contact with said drive roller in at least two positions defining a nip in each position, wherein a first idler roller position is rotated about an angle ranging from about 5° to about 15° from a second idler roller position, and wherein said drive roller moves said idler roller from said first idler roller position to said second idler roller position.

2. The inverter according to claim 1, wherein said idler roller contacts said drive roller in said second position defining a nip therebetween for ejecting the sheet from the inverter.

3. The inverter according to claim 1, further comprising an idler bracket guide for constraining the movement of said idler roller between said first position and said second position.

4. A method of operating an inverter apparatus for reversing the orientation of a moving paper sheet, comprising the steps of:

receiving a lead edge of said moving sheet into a first continuously driven nip including a first continuously driven main drive roller and a first idler roller;

operating a bi-directionally driven nip in a first direction, said nip including a forward/reverse driven roller and a multiple-position idler roller, wherein said multiple-position idler roller rotates into a first position having a range from about 5° to about 15° from a second position;

receiving said lead edge of said moving sheet into said bi-directionally driven nip;

operating said bi-directionally driven nip in a direction opposite the first direction, wherein said multiple-position idler moves from said first idler roller position to said second idler roller position through friction with said forward/reverse driven roller;

receiving said trailing edge of said moving sheet into a second continuously driven nip including said first continuously driven main drive roller and a second idler roller;

expelling said sheet from said second continuously driven nip in said reversed orientation.

5. The method according to the claim 4, step of rotating said multiple position idler from said first idler roller position to said second idler roller position includes the step of constraining said movement with an idler bracket guide.

6. An electrophotographic printing machine having a device for inverting a sheet along a paper path, the improvement comprising:

a drive roller; and an idler roller in circumferential contact with said drive roller in at least two positions defining a nip in each position, wherein a first idler roller position is rotated about an angle ranging from about 5° to about 15° from a second idler roller position, and wherein said drive roller moves said idler roller from said first idler roller position to said second idler roller position.

7. A printing machine according to claim 6, wherein said idler roller contacts said drive roller in a second position defining a nip therebetween for ejecting the sheet from the inverter.

8. A printing machine according to claim 6, further comprising an idler bracket guide for constraining the movement of said idler roller between said first idler roller position and said second idler roller position.

* * * * *